US009162437B2

(12) United States Patent
Willshere

(10) Patent No.: US 9,162,437 B2
(45) Date of Patent: Oct. 20, 2015

(54) FRAME ASSEMBLY FOR SUPPORTING PRINTING SCREENS, A FRAME SUPPORT MECHANISM FOR SUPPORTING THE SAME, AND A METHOD OF MOUNTING PRINTING SCREENS IN A SCREEN PRINTING MACHINE

(75) Inventor: Jeffrey Richard Willshere, Dorchester (GB)

(73) Assignee: ASM Assembly Systems Switzerland GmbH, Zurich (CH)

( * ) Notice: Subject to any disclaimer, the term of this patent is extended or adjusted under 35 U.S.C. 154(b) by 599 days.

(21) Appl. No.: 12/682,078

(22) PCT Filed: Oct. 16, 2008

(86) PCT No.: PCT/EP2008/008769

§ 371 (c)(1),
(2), (4) Date: Aug. 25, 2010

(87) PCT Pub. No.: WO2009/047012

PCT Pub. Date: Apr. 16, 2009

(65) Prior Publication Data

US 2010/0307353 A1 Dec. 9, 2010

(30) Foreign Application Priority Data

Oct. 8, 2007 (GB) ..... 0719657.9

(51) Int. Cl.
*B41F 15/36* (2006.01)
*B41F 15/44* (2006.01)

(52) U.S. Cl.
CPC ..... *B41F 15/36* (2013.01); *B41F 15/44* (2013.01)

(58) Field of Classification Search
CPC ..... B41F 15/34; B41F 15/36; B41F 15/44; H05K 3/1225
USPC ..... 101/128.1, 128, 127.1, 127, 126
See application file for complete search history.

(56) References Cited

U.S. PATENT DOCUMENTS 4,223,602 A * 9/1980 Mitter ..... 101/128.21
4,694,746 A 9/1987 Hamu (Continued)

FOREIGN PATENT DOCUMENTS

DE 27 22 060 11/1978
DE 30 43 666 7/1982

(Continued)

OTHER PUBLICATIONS

International Search Report for corresponding application No. PCT/EP2008/008769 dated Nov. 16, 2009.

*Primary Examiner* — Blake A Tankersley
*Assistant Examiner* — Leo T Hinze
(74) *Attorney, Agent, or Firm* — Renner, Otto, Boisselle & Sklar, LLP

(57) ABSTRACT

A frame assembly for supporting a printing screen, the frame assembly comprising: a frame unit to which a printing screen is in use supported; and a screen loading mechanism for loading a printing screen into and unloading a printing screen from the frame unit, wherein the screen loading mechanism comprises a screen loading member which is movably coupled to the frame unit between a screen-receiving position in which a printing screen can be loaded into or removed from the screen loading member and a loaded position in which the printing screen is loaded into the frame unit, and at least one actuator element which is coupled to the screen loading member and actuatable to move the screen loading member between the screen-receiving and loaded positions.

19 Claims, 6 Drawing Sheets

(56) References Cited

U.S. PATENT DOCUMENTS

| | | | | |
|---|---|---|---|---|
| 5,979,313 | A * | 11/1999 | Fromm | 101/127.1 |
| 6,038,969 | A * | 3/2000 | Podlipec et al. | 101/127.1 |
| 6,817,288 | B2 | 11/2004 | Flatt | |
| 2008/0216681 | A1 * | 9/2008 | Shaw et al. | 101/128.1 |
| 2009/0217831 | A1 * | 9/2009 | Cane et al. | 101/126 |

FOREIGN PATENT DOCUMENTS

| | | |
|---|---|---|
| DE | 4342303 | 6/1995 |
| GB | 2317366 | 3/1998 |
| GB | 2435011 | 8/2007 |
| WO | 03/093012 | 11/2003 |
| WO | 2005/046994 | 5/2005 |

* cited by examiner

FRAME ASSEMBLY FOR SUPPORTING PRINTING SCREENS, A FRAME SUPPORT MECHANISM FOR SUPPORTING THE SAME, AND A METHOD OF MOUNTING PRINTING SCREENS IN A SCREEN PRINTING MACHINE

The present invention relates to a frame assembly for supporting de-mountable printing screens, often alternatively referred to as stencils or foils, for use in a screen printing machine, a frame support mechanism for supporting the same, and a method of mounting printing screens in screen printing machines.

A printing screen, typically comprising a screen sheet formed of a metal or plastic, includes apertures which define the pattern to be printed, with the screen being located over an object to be printed and printing medium forced through the apertures to provide the required print.

De-mountable printing screens are finding increasing favour as compared to glued screens. Key benefits include ease of use, cheaper replacement cost, improved handling logistics in not requiring the frame to be returned when requiring a replacement printing screen, and fewer frames are needed as many printing screens can be used in one frame. Various competing systems are in use, including the VECTORGUARD® frame system, as supplied by DEK INTERNATIONAL GMBH (Zürich, Switzerland), and disclosed in WO-A-2003/093012.

The current frame systems for printing liquid print media onto planar substrates require the printing screens to be loaded and tensioned in frames externally of the screen printing machines, using a loading/unloading jig. In requiring the removal of the frame from the screen printing machine, the print head, typically a squeegee mechanism, has be lifted clear of the frame, and also any residual print medium has to be removed from the printing screen. The size and weight of the frame and accompanying foil make this operation awkward, and the need to remove the residual print medium can make the process particularly time consuming.

It is an aim of the present invention to provide an improved frame assembly and frame supporting mechanism, which allows for the in situ replacement of printing screens. Although printing screens are only slightly smaller in size than the supporting frame, printing screens are considerably lighter and easier to handle.

In one aspect the present invention provides a frame assembly for tensioning a printing screen, the frame assembly comprising: a frame unit to which a printing screen is in use tensioned; and a screen loading mechanism for loading a printing screen into and unloading a printing screen from the frame unit, wherein the screen loading mechanism comprises a screen loading member which is movably coupled to the frame unit between a screen-receiving position in which a printing screen can be loaded into or removed from the screen loading member and a loaded position in which the printing screen is loaded into the frame unit, and at least one actuator element which is coupled to the screen loading member and actuatable to move the screen loading member between the screen-receiving and loaded positions.

The present invention also extends to a screen printing machine incorporating the above-described frame assembly.

In another aspect the present invention provides a screen printing machine, comprising: a frame unit to which a printing screen is in use tensioned; and a screen loading mechanism for loading a printing screen into and unloading a printing screen from the frame unit, wherein the screen loading mechanism comprises a screen loading member which is movably coupled to the frame unit between a screen-receiving position in which a printing screen can be loaded into or removed from the screen loading member and a loaded position in which the printing screen is loaded into the frame unit, and at least one actuator element which is coupled to the screen loading member and actuatable to move the screen loading member between the screen-receiving and loaded positions.

In a further aspect the present invention provides a frame support mechanism for supporting a frame assembly which includes a de-mountable printing screen, the frame support mechanism comprising: a frame support member to which a frame assembly is in use mounted, wherein the frame assembly comprises a screen loading member which is movable between a screen-receiving position in which a printing screen can be loaded into or removed from the screen loading member and a loaded position in which the printing screen is loaded in an operative position in the frame assembly, and at least one actuator element which is coupled to the screen loading member and actuatable to move the screen loading member between the screen-receiving and loaded positions; and an actuator mechanism which is operable to actuate the at least one actuator element of the frame assembly to move the screen loading member of the frame assembly between the screen-receiving and loaded positions.

The present invention also extends to a screen printing machine incorporating the above-described frame support mechanism.

In a still further aspect the present invention provides a screen printing machine, comprising: a frame support member to which a frame assembly is in use mounted, wherein the frame assembly comprises a screen loading member which is movable between a screen-receiving position in which a printing screen can be loaded into or removed from the screen loading member and a loaded position in which the printing screen is loaded in an operative position in the frame assembly, and at least one actuator element which is coupled to the screen loading member and actuatable to move the screen loading member between the screen-receiving and loaded positions; and an actuator mechanism which is operable to actuate the at least one actuator element of the frame assembly to move the screen loading member of the frame assembly between the screen-receiving and loaded positions.

In a yet further aspect the present invention provides a frame assembly for tensioning a printing screen, the frame assembly comprising: a frame unit to which a printing screen is in use tensioned, wherein the frame unit includes a support station adjacent an inner edge thereof onto which a print head can be parked prior to separation of the printing screen from the frame unit, such as to provide for removal of the print head and associated print medium from the printing screen prior to separation of the printing screen from the frame unit.

The present invention also extends to a screen printing machine incorporating the above-described frame assembly.

In a still yet further aspect the present invention provides a screen printing machine, comprising: a frame unit to which a printing screen is mounted; and a support station onto which a print head can be parked prior to separation of the printing screen from the frame support member, such as to provide for removal of the print head and associated print medium from the printing screen prior to separation of the printing screen from the frame support member.

In yet another aspect the present invention provides a method of mounting a printing screen in a screen printing machine, comprising the steps of: providing a frame unit to which a printing screen is mounted; providing a screen loading mechanism for loading a printing screen into and unloading a printing screen from the frame unit, wherein the screen loading mechanism comprises a screen loading member which is movably coupled to the frame unit between a screen-receiving position in which a printing screen can be loaded into or removed from the screen loading member and a loaded position in which the printing screen is loaded into the frame unit; moving the screen loading member to the screen-receiving position; loading a printing screen into the screen loading member when positioned in the screen-receiving position; and moving the screen loading member to the loaded position in which the printing screen is loaded into the frame unit.

In yet still another aspect the present invention provides a method of mounting a printing screen in a screen printing machine, comprising the steps of: providing a frame unit to which a printing screen is mounted; providing a support station adjacent an inner edge of the frame unit onto which a print head can be parked prior to separation of the printing screen from the frame unit; and parking a print head on the support station prior to removing the printing screen from the frame unit, thereby enabling removal of the print head and associated print medium from the printing screen prior to separation of the printing screen from the frame unit.

Preferred embodiments of the present invention will now be described hereinbelow by way of example only with reference to the accompanying drawings, in which.

Figure 1:
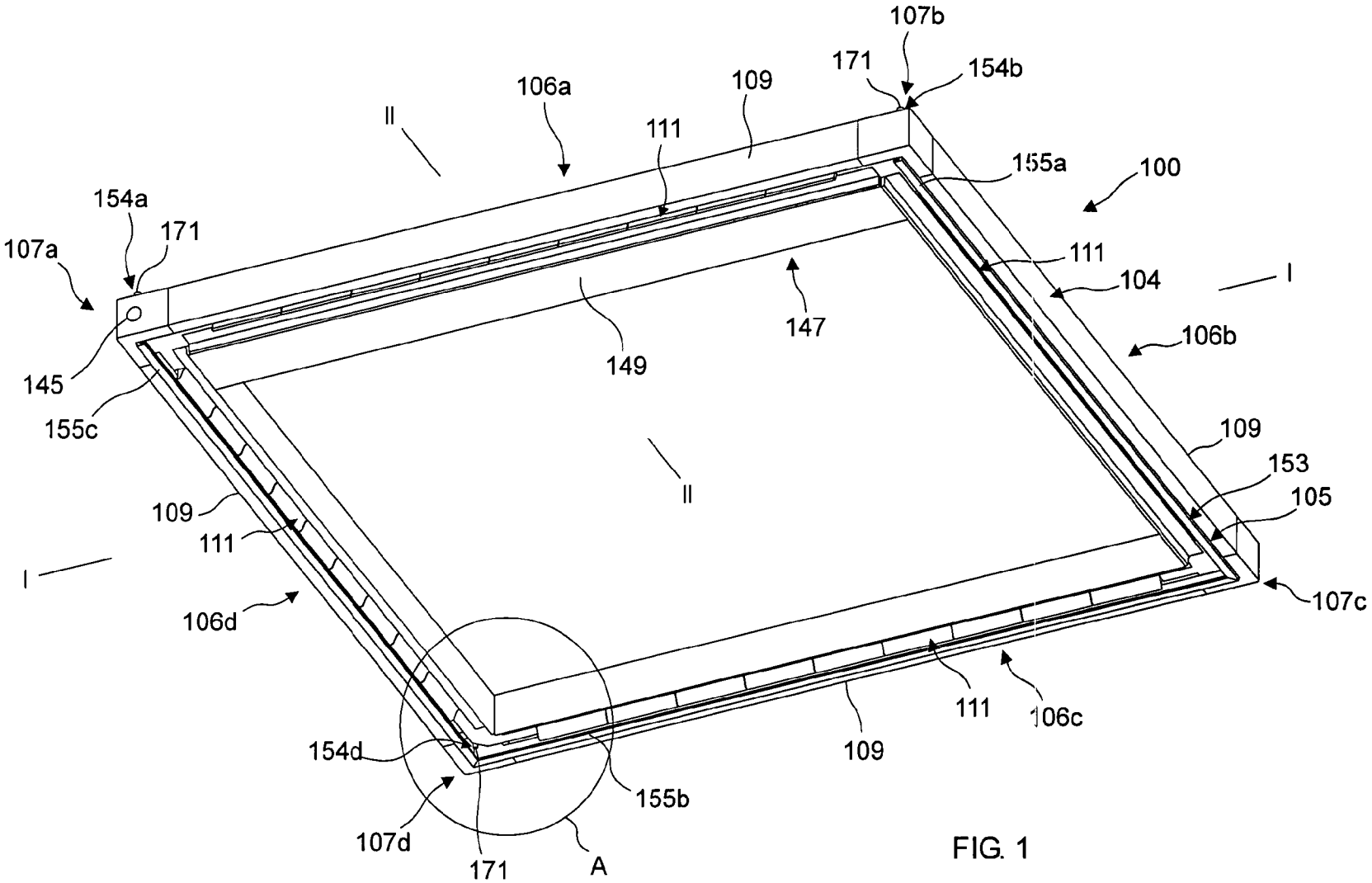
FIG. 1 illustrates a perspective view from below of a frame assembly for tensioning a printing screen in accordance with a preferred embodiment of the present invention.
Figure 2:
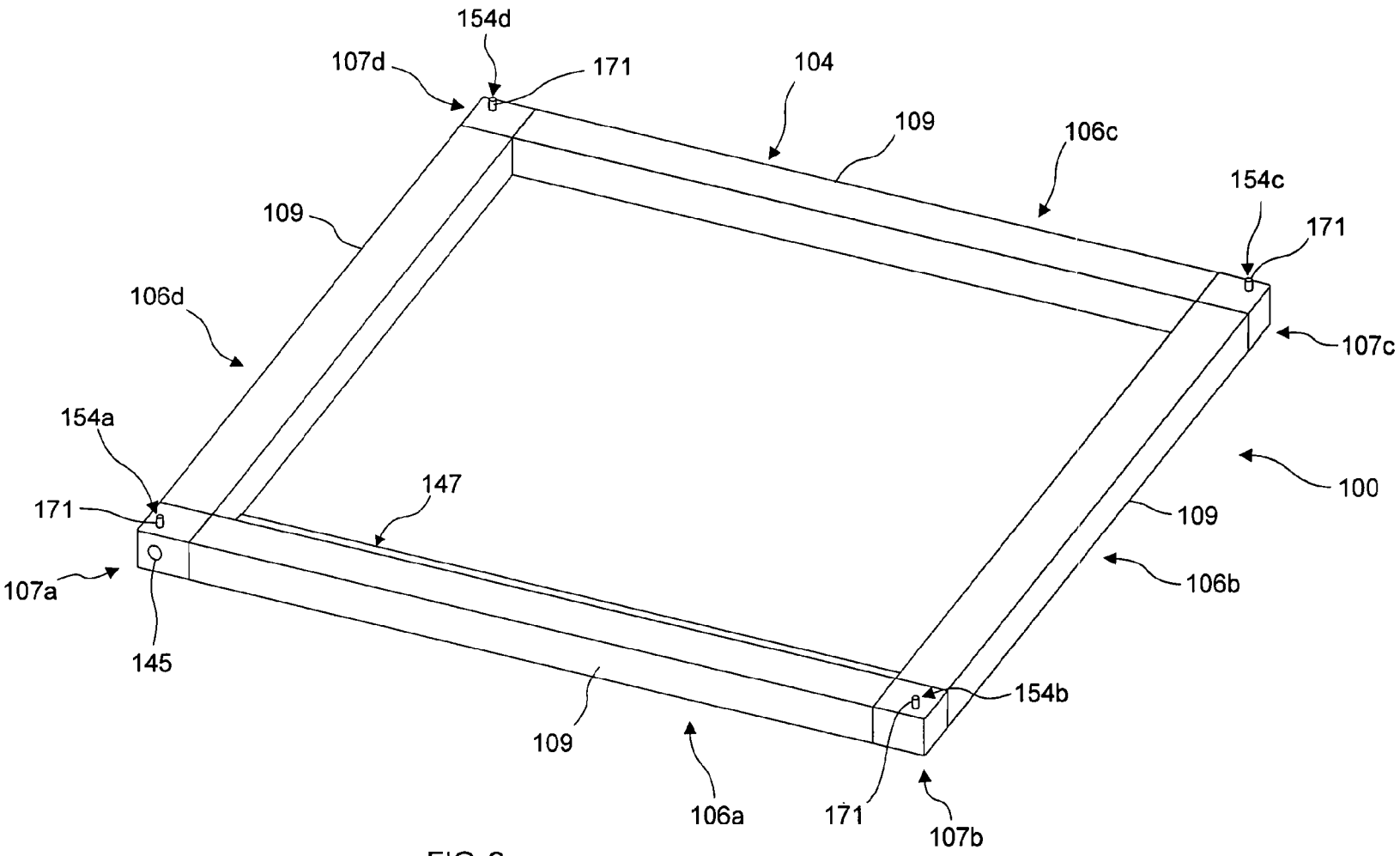
FIG. 2 illustrates a perspective view from above of the frame assembly of FIG. 1.
Figure 7A:
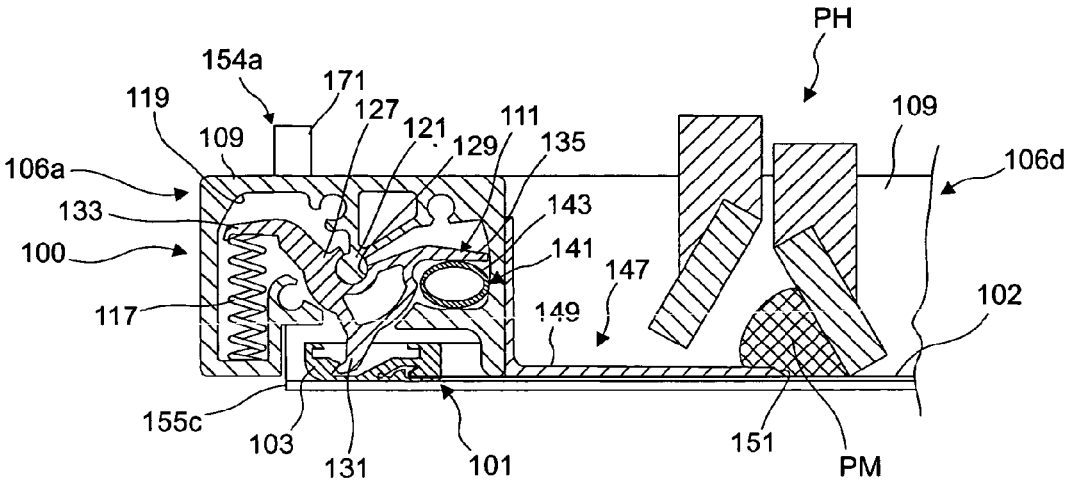
Figure 7B:
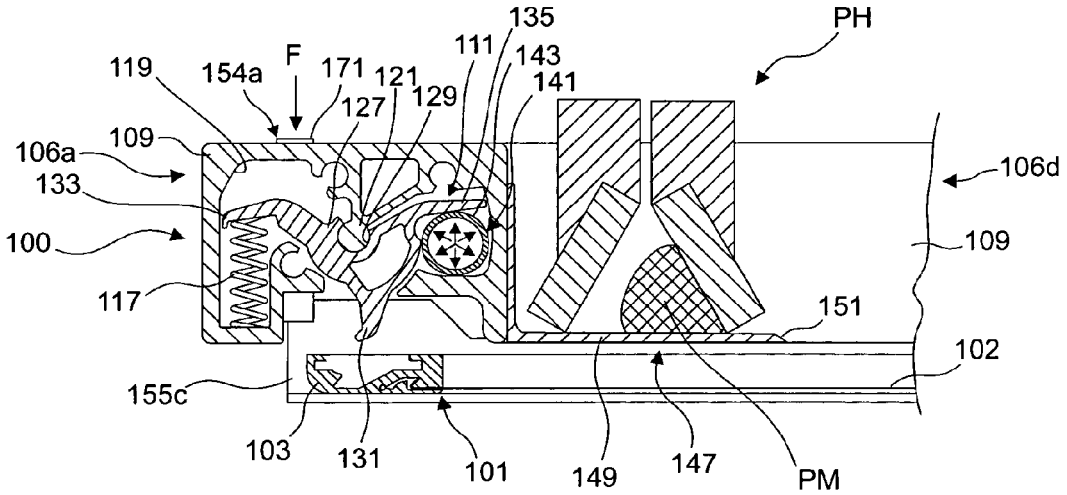

FIGS. 6(*a*) to (*e*) illustrate the operation of the frame assembly of FIG. 1 when mounting a printing screen thereto; and FIGS. 7(*a*) and (*b*) illustrate steps in the operation of the frame assembly of FIG. 1 when de-mounting a printing screen therefrom.

FIGS. 1 to 5 illustrate a frame assembly 100 for tensioning a printing screen 101 in accordance with a preferred embodiment of the present invention.

Figure 4:
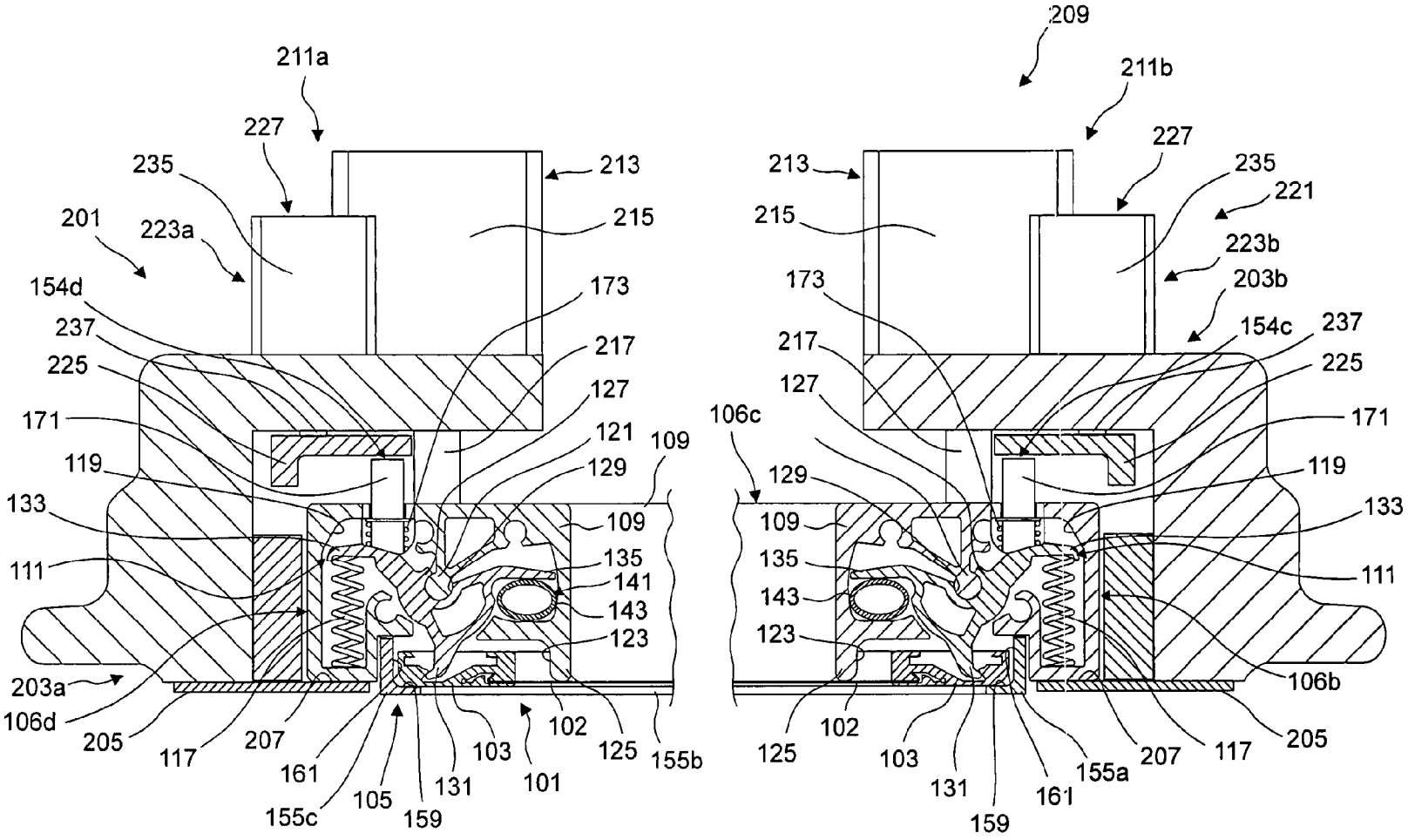
FIG. 4 illustrates a first vertical sectional view (along section I-I in FIG. 1) through the frame assembly of FIG. 1, where mounted in a frame supporting mechanism in accordance with a preferred embodiment of the present invention.
Figure 6A:
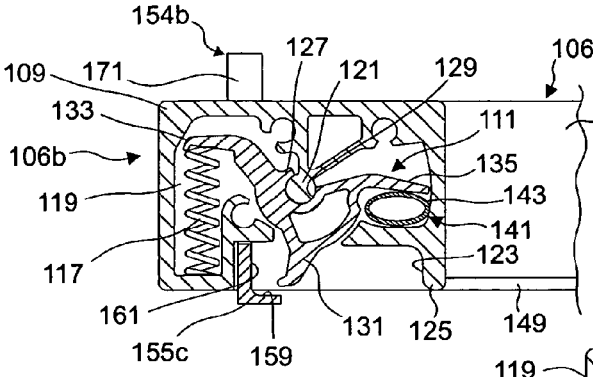
Figure 6B:
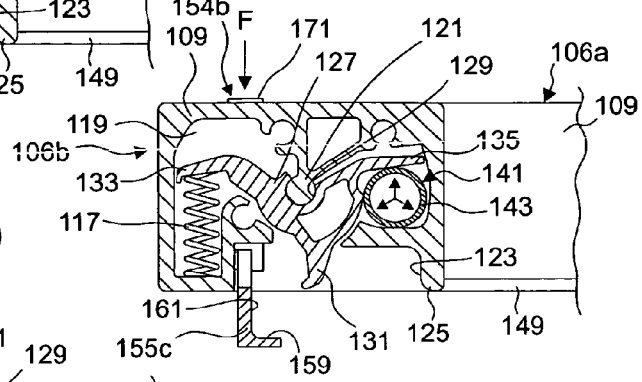
Figure 6C:
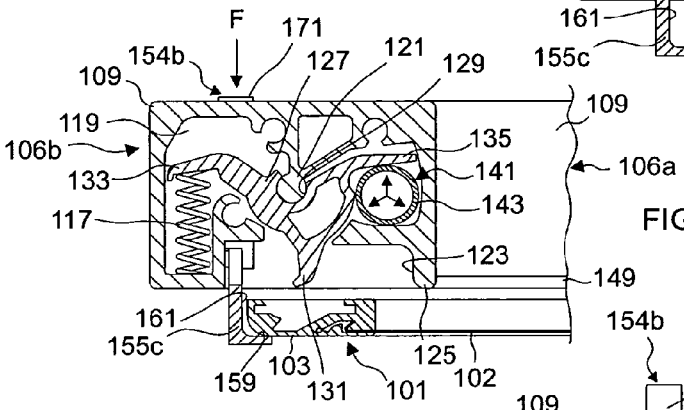
Figure 6D:
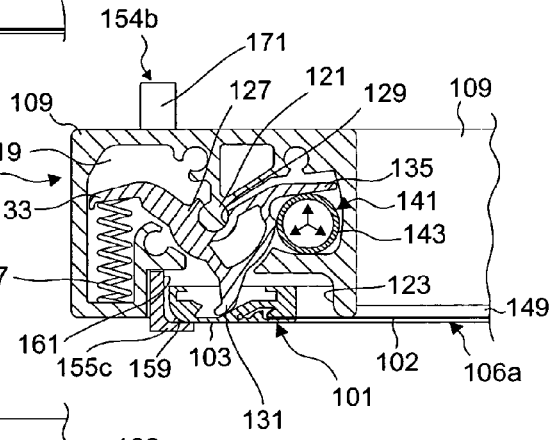
Figure 6E:
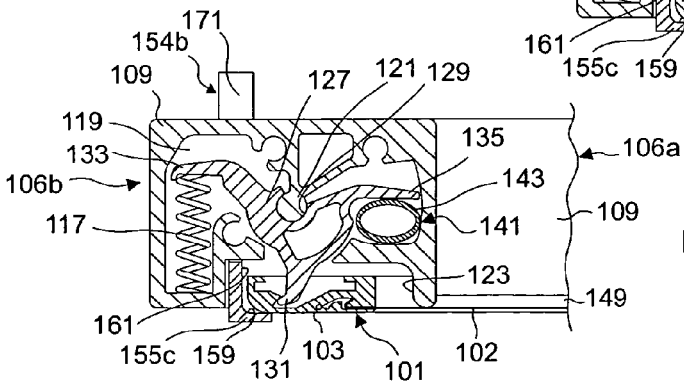

In this embodiment, as illustrated in FIG. 4, the screen 101 comprises a screen sheet 102, typically formed of a metal or plastic, which includes a pattern of apertures through which a printing medium is printed, and engagement members 103 at each of the edges of the screen sheet 102 by which the screen 101 is tensioned. WO-A-2003/093012 discloses examples of such printing screens.

The frame assembly 100 comprises a frame unit 104 to which the screen 101 is tensioned and a loading mechanism 105 for loading the screen 101 into the frame unit 104.

The frame unit 104 comprises first, second, third and fourth frame members 106*a-d*, in this embodiment elongate members, for engaging respective edges of the screen 101, and first, second, third and fourth corner pieces 107*a-d* which connect the respective ends of the frame members 106*a-d*. In this embodiment the frame members 106*a-d* are connected to the corner pieces 107*a-d* by screws, but in an alternative embodiment the frame members 106*a-d* and the corner pieces 107*a-d* could be configured to be a press-fit connection.

The frame members 106*a-d* each comprise a frame element 109, which frame elements 109 are connected to the respective corner pieces 107*a-d*, in this embodiment by screws, such as to define a rigid frame, a plurality of engagement elements 111 for engaging a respective edge of the screen 101, in this embodiment through the engagement member 103 at the respective edge of the screen 101, which engagement elements 111 are pivotally coupled to the frame element 109 such as to be pivotable in one, tensioning sense to tension the screen 101 and the other, opposite sense to allow for fitting and removal of the screen 101, and a plurality of biasing elements 117 for applying a biasing force to respective ones of the engagement elements 111, which biasing force acts to bias the engagement elements 111 to pivot in the tensioning sense and apply a tension to the respective edge of the screen 101. In this embodiment the provision of a plurality of engagement elements 111 for engagement with each edge of the screen 101 facilitates the application of a controlled tension across the length of each edge of the screen 101. In addition, the provision of a plurality of engagement elements 111 for engagement with each edge of the screen 101 allows for each edge of the screen 101 to be tensioned with a predeterminable tension profile, for example, to a higher tension at the respective ends.

Each of the frame elements 109 includes a central, elongate cavity 119 in which the respective engagement elements 111 are disposed along the length thereof, and a pivot bead 121, in this embodiment a part-circular bead, which extends along the length of the cavity 119 to which the respective engagement elements 111 are pivotally hinged, as will be described in more detail hereinbelow. In this embodiment the engagement elements 111 of each frame member 106*a-d* are juxtaposed in end-to-end relation. In an alternative embodiment the engagement elements 111 of each frame member 106*a-d* could be disposed in spaced relation.

Each of the frame elements 109 further includes an elongate, screen recess 123 at a lower, mounting surface for receiving the engagement member 103 at the respective edge of the screen 101 and into which the respective engagement elements 111 extend to engage the engagement member 103, and a guide 125 at an inner edge over which the screen sheet 102 of the screen 101 is tensioned.

In this embodiment the frame elements 109 are fabricated from an extrusion, here an aluminum extrusion, with the extrusion being sectioned at the required lengths.

Each of the engagement elements 111 comprises a body 127 which includes a pivot recess 129, in this embodiment a part-circular recess, which extends along the length thereof and in which the pivot bead 121 of the respective frame element 109 is held captive, whereby the engagement elements 111 are captively pivotable to the respective frame elements 109.

Each of the engagement elements 111 further includes a first, engagement arm 131 which extends into the screen recess 123 in the respective frame element 109 for engagement with the engagement member 103 at the respective edge of the screen 101. In this embodiment the engagement arm 131 extends substantially orthogonally to the lower, mounting surface of the respective frame element 109. In this embodiment the engagement arm 131 comprises a continuous bar, but in other embodiments can have any desired form, for example, as a comb structure for engaging slots which provide the engagement member 103 at the respective edge of the screen 101.

Each of the engagement elements 111 further includes a second, biasing arm 133 which is engaged by respective ones of the biasing elements 117, in this embodiment by a pair of the biasing elements 117, such as to bias the engagement element 111 to pivot in the tensioning sense, whereby the distal end of the engagement arm 131 is biased in a direction outwardly from the inner edge of the respective frame element 109 to tension the respective edge of the screen 101. In this embodiment the biasing arm 133 extends substantially parallel to the lower, mounting surface of the respective frame element 109 in a direction towards the outer edge of the respective frame element 109. In this embodiment the biasing elements 117 are configured to apply a biasing force to the biasing arm 133 in a direction substantially orthogonal to the lower mounting surface of the respective frame element 109.

Each of the engagement elements 111 further includes a third, operating arm 135 which allows for operation of the engagement elements 111 to enable the fitting of the screen 101, as will be described in more detail hereinbelow. In this embodiment the operating arm 135 extends substantially parallel to the lower, mounting surface of the respective frame element 109 in a direction towards the inner edge of the respective frame element 109.

In this embodiment the engagement elements 111 are fabricated from an extrusion, here an aluminum extrusion, with the extrusion being sectioned at the required lengths.

Figure 3:
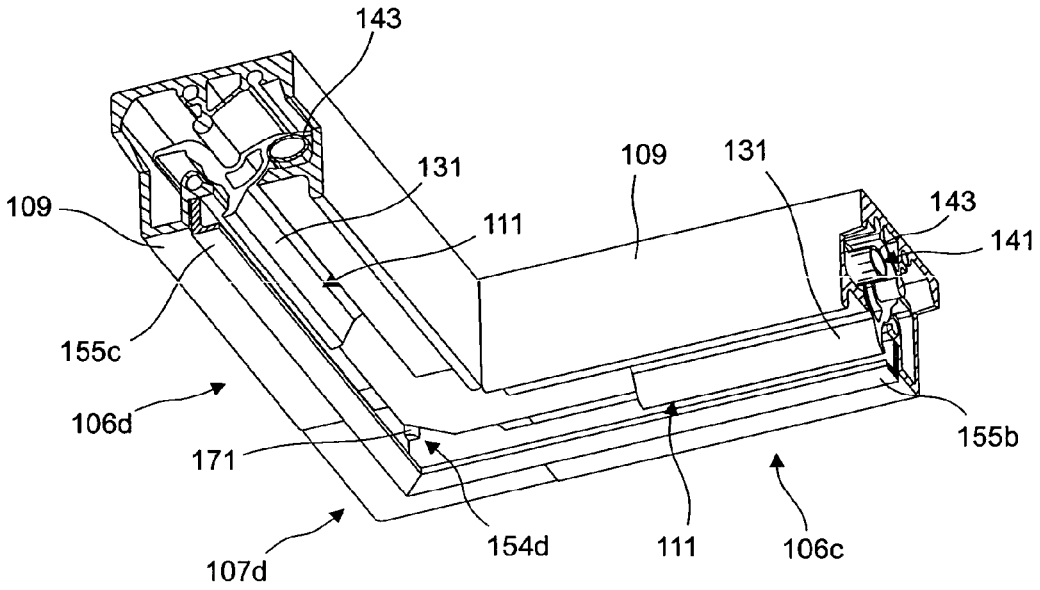
FIG. 3 illustrates in enlarged scale a fragmentary perspective view (region A in FIG. 1) from below of one corner of the frame assembly of FIG. 1.

The frame unit 104 further comprises a counter-biasing element 141 which is operable, in this embodiment commonly, to engage the operating arms 135 of each of the engagement elements 111 to apply a counter-biasing force to the operating arms 135, such as to counter-bias the engagement elements 111 to overcome the normal biasing force of the biasing elements 117 and cause the engagement elements 111 to adopt a position in which the screen 101 is released from engagement with the engagement elements 111, such as to allow for the fitting or removal of the screen 101. In this embodiment the counter-biasing element 141 comprises a single elongate inflatable bladder 143, here a pneumatic bladder, which is threaded through the central cavities 119 of the frame elements 109 adjacent the operating arms 135 of the engagement elements 111 and through the corner pieces 107*a-d*, as illustrated in FIG. 3, and a fluid connector 145, here a quick-fit pneumatic connector, which is connected to one end of the bladder 143 such as to allow for inflation and deflation of the bladder 143 by a separate actuator (not illustrated), with the other end of the bladder 143 being closed. In this embodiment the fluid connector 145 is mounted in one of the corner pieces 107*a-d*, here the first corner piece 107*a*. In this embodiment the counter-biasing element 141 is configured to apply a counter-biasing force to the operating arms 135 in a direction substantially orthogonal to the lower, mounting surface of the respective frame elements 109.

Figure 5:
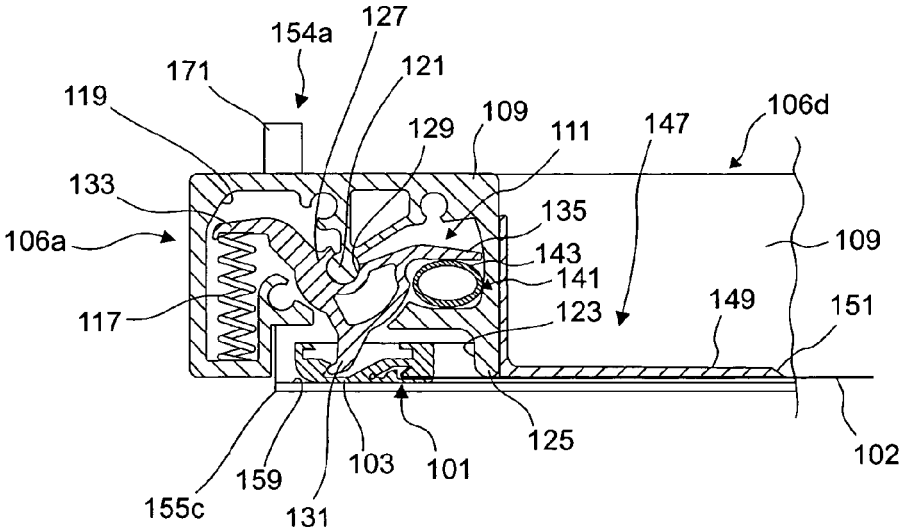
FIG. 5 illustrates a second vertical sectional view (along section II-II in FIG. 1) through one of the frame members of the frame assembly of FIG. 1.

As illustrated in FIG. 5, the frame unit 104 further comprises a support station 147 which is located adjacent the inner edge of the frame element 109 of one of the frame members 106*a-d*, in this embodiment the first frame member 106*a*, onto which a print head PH, such as a squeegee mechanism, can be parked, such as to support the print medium PM which is being operated upon by the print head PH and thereby allow for the screen 101 to be changed without requiring any special action in relation to the print head PH and in particular the print medium PM, typically the removal of the print medium PM from the surface of the screen 101 as would otherwise be required.

In this embodiment the support station 147 includes a planar, sheet element 149, which extends inwardly from the lower surface of the frame element 109 and has a sufficient width to receive the print head PH thereon. In this embodiment the sheet element 149 has a tapered leading edge 151, such as to facilitate the movement of the print head PH thereonto.

The screen loading mechanism 105 comprises a loading member 153 which is movably coupled to the frame unit 104 between a screen-receiving position, as illustrated in FIG. 6(*c*), in which the loading member 153 is spaced from the frame unit 104 to allow the screen 101 to be loaded into the loading member 153, and a loaded position, as illustrated in FIG. 6(*d*), in which the screen 101 is located at the frame unit 104 at a position which allows for tensioning of the screen 101, and at least one actuator element 154, in this embodiment a plurality of actuator elements 154*a-d* which are coupled to the loading member 153 such as to move the loading member 153 between the screen-receiving and loaded positions on actuation.

In this embodiment the loading member 153 comprises a plurality of support elements 155 which are movably coupled to the frame elements 109 of respective ones of the frame members 106*a-d*, in this embodiment first, second and third support elements 155*a, b, c* which are movably coupled to the frame elements 109 of the second, third and fourth frame members 106*b, c, d* and together define a U-shaped section when viewed from above, which allows for the screen 101 to be slid thereinto and captively received.

In this embodiment the support elements 155*a-c* comprise elongate elements which extend along the lengths of the respective ones of the frame elements 109.

The support elements 155*a-c* each define a support surface 159, on which the screen 101 is supported, and a guide surface 161, which acts to guide the screen 101 to the required position for loading the screen 101 into the frame unit 104. In this embodiment the support elements 155*a, b, c* comprise L-shaped bars, the inner faces of which define the support and guide surfaces 159, 161. With this configuration, the opposing support elements 155*a, c*, in this embodiment at the frame elements 109 of the second and fourth frame members 106*b, d*, act as lateral guides as the screen 101 is slid onto the loading member 153, and the other, rear support element 155*b* acts as a rear guide, which defines a stop to the extent of insertion of the screen 101.

In this embodiment the actuator elements 154*a-d* are coupled to the respective ends of the support elements 155*a-c*, with the third and fourth actuator elements 154*c, d* being commonly coupled to the ends of the first and second support elements 155*a, b* and the second and third support elements 155*b, c*, respectively.

In this embodiment the actuator elements 154*a-d* extend from respective ones of the corner pieces 107*a-d*, here in symmetrical relation, and at the respective sides of the frame assembly 100. This configuration advantageously provides for actuation of the actuator elements 154*a-d* irrespective of the extent to which the frame assembly 100 is inserted into the screen printing machine, and thereby allows for manual positioning of the frame assembly 100 by the operator to a desired position, and is not constrained to a position as defined by the actuator elements 154*a-d*.

In this embodiment, as illustrated in FIG. 4, the actuator elements 154*a-d* each comprise an actuator pin 171 which projects from the other, upper surface of the frame unit 104 to which the support member 153 is located, and a biasing element 173, here a resilient element, such as a compression spring, which is operative normally to bias the actuator pin 171 to an extended, rest position, as illustrated in FIG. 6(*a*), in which the support member 153 is in the loaded position. With this configuration, the actuator pins 171 can be moved from the extended, rest position to a depressed, actuated position, as illustrated in FIG. 6(*b*), in which the actuator pins 171 are depressed and the support member 153 is moved to the screen-receiving position for allowing the screen 101 to be loaded thereinto or removed therefrom.

FIG. 4 illustrates a frame support assembly 201 in accordance with a preferred embodiment of the present invention, in this embodiment of a screen printing machine, where supporting the frame assembly 100.

The frame support assembly 201 comprises first and second frame support members 203*a, b*, in this embodiment elongate members, which are disposed in opposed relation to receive opposite frame members 106*d, b* of the frame assembly 100.

In this embodiment the frame support members 203*a, b* each comprise a support element 205, here in the form of a shelf, which defines a support surface 207 for supporting the frame members 106*d, b* of the frame assembly 100.

In this embodiment the frame support assembly 201 further comprises a frame clamping mechanism 209 for clamping the frame assembly 100 to the frame support assembly 201.

In this embodiment the frame clamping mechanism 209 comprises first and second clamp units 211*a, b*, which are associated with respective ones of the first and second frame support members 203*a, b* and operative to clamp the frame assembly 100 to the frame support assembly 201.

In this embodiment the first and second clamp units 211*a, b* each comprise at least one piston element 213, here comprising a piston 215 and a piston rod 217, which is actuated by the piston 215 to clamp the frame assembly 100 to the frame support members 203*a, b* of the frame support assembly 201.

In an alternative embodiment the frame assembly 100 could be permanently mounted in the screen printing machine, but such permanent mounting does not allow for any "rough" manual positioning of the frame assembly 100 relative to the printing zone.

In another alternative embodiment the frame elements 109 of the frame assembly 100 could be formed as an integral part of the screen printing machine, and in one embodiment define part of the chassis or supporting frame of the screen printing machine. This configuration advantageously reduces the complexity and weight of the screen printing machine, in avoiding the need for a separate frame support assembly 201, which is necessarily of bulky construction to support the relatively-large frame assembly 100.

The frame support assembly 201 further comprises an actuator mechanism 221 for actuating the actuator elements 154*a-d* of the loading mechanism 105 of the frame assembly 100.

In this embodiment the actuator mechanism 221 comprises first and second actuator units 223*a, b*, which are associated with respective ones of the first and second frame support members 203*a, b* and operative to actuate the actuator elements 154*a-d* of the loading mechanism 105 of the frame assembly 100.

In this embodiment the actuator units 223*a, b* each comprise an actuator element 225, in this embodiment an elongate plate which extends over a length corresponding to the length of the frame members 106*d, b*, and at least one piston element 227, in this embodiment a plurality of piston elements 227, here each comprising a piston 235 and a piston rod 237, which is actuated by the piston 235 to drive the actuator element 225 to actuate the actuator elements 154*a-d* of the loading mechanism 105 of the frame assembly 100.

Operation of the frame assembly 100 and the frame support assembly 201 will now be described hereinbelow.

The fitting of a printing screen 101 to the frame assembly 100 will now be described hereinbelow with reference to FIGS. 6(*a*) to (*e*).

FIG. 6(*a*) illustrates the normal, rest configuration of the frame assembly 100.

In a first operation, the counter-biasing element 141 is actuated, in this embodiment by inflating the bladder 143, to apply a counter-biasing force to the operating arms 135 of the engagement elements 111, such as to counter-bias the engagement elements 111 to overcome the normal biasing force of the biasing elements 117 and cause the engagement elements 111 to adopt a screen-receiving position for receiving the screen 101, and the actuator elements 154*a-d* are actuated, here by depression of the actuator pins 171 thereof by the actuator units 223*a, b* of the frame support assembly 201, such as to move the screen support member 153 to the screen-receiving position, in this embodiment in a spaced, lowered position relative to the frame members 106*a-d* of the frame unit 104, as illustrated in FIG. 6(*b*).

As illustrated in FIG. 6(*c*), the screen 101 is then located in position on the screen support member 153, in this embodiment by sliding the screen 101 into the support member 153 to a loaded position.

Following loading of the screen 101 into the screen support member 153, the actuator elements 154*a-d* are returned to the first, rest position, in this embodiment by actuating the actuator units 223*a, b* of the frame support assembly 201 to release the biasing force from the actuator pins 171 thereof, whereby the screen support member 153 is moved to the loaded position, as illustrated in FIG. 6(*d*), in which the engagement members 103 at the edges of the screen 101 are located in the screen recesses 123 in the frame elements 109 of the respective frame members 106*a-d*.

Following mounting of the screen 101 to the frame unit 104, the counter-biasing element 141 is de-actuated, in this embodiment by deflating the bladder 143, which de-actuation causes the engagement elements 111 to be pivoted by the biasing force of the biasing elements 117 in the tensioning sense, such as to tension the respective edges of the screen 101, as illustrated in FIG. 6(*e*).

The removal of a printing screen 101 from the frame unit 104 is achieved by performing the reverse sequence of operations, but with the additional step of parking a print head PH, in this embodiment a squeegee mechanism comprising a pair of opposed blades, on the support station 147 prior to separation of the screen 101 from the frame unit 104, as illustrated in FIGS. 7(*a*) and (*b*), such as to support the print medium PM which is being operated upon by the print head PH and thereby allow for the screen 101 to be changed without requiring any special action in relation to the print head PH and in particular the print medium PM, typically the removal of the print medium PM from the surface of the screen 101 as would otherwise be required.

Finally, it will be understood that the present invention has been described in its preferred embodiments and can be modified in many different ways without departing from the scope of the invention as defined by the appended claims.

In one alternative embodiment the frame members 106*a-d* could each include a single, elongate engagement element 111.

In other alternative embodiments the biasing elements 117 could be provided by any kind of resilient element, whether tensioned or compressed.

In yet another alternative embodiment the biasing elements 117 could be provided by actuatable elements, for example, an inflatable bladder of the kind as embodied in relation to the counter-biasing element 141.

Also, in the described embodiments the inflatable bladder 143 of the counter-biasing element 141 is pneumatically operated, but in other embodiments could be hydraulically operated.

The invention claimed is:

1. A frame assembly for supporting a printing screen, the frame assembly comprising:

a frame unit to which a printing screen is in use supported; and a screen loading mechanism for loading the printing screen into and unloading the printing screen from the frame unit, wherein the screen loading mechanism comprises a screen loading member which is adapted to receive and support the printing screen in a screen-receiving position which is spaced from the frame unit and in which the printing screen can be loaded into or removed from the screen loading member, and the screen loading member is movably coupled to the frame unit between the screen-receiving position and a loaded position which is spaced from the screen-receiving position and in which the printing screen is moved towards the frame unit and loaded into the frame unit, and at least one actuator element which is coupled to the screen loading member and actuatable to move the screen loading member between the screen-receiving and loaded positions.

2. The frame assembly of claim 1, wherein the screen loading mechanism comprises a plurality of actuator elements.

3. The frame assembly of claim 2, wherein the actuator elements are arranged to allow for loading of the frame assembly into a screen printing machine in more than one position.

4. The frame assembly of claim 1, wherein the frame unit comprises a plurality of frame members, and the screen loading member comprises a plurality of support elements which engage edges of the printing screen and are movably coupled to respective ones of the frame members.

5. The frame assembly of claim 4, wherein the screen loading member comprises at least two support elements which are disposed in opposed relation slidingly to receive the printing screen.

6. The frame assembly of claim 4, wherein the frame members comprise elongate members and the support elements comprise elongate elements which extend along a length of the respective frame members.

7. The frame assembly of claim 6, wherein the screen loading mechanism comprises a plurality of actuator elements-which are coupled to respective ends of the support elements.

8. The frame assembly of claim 1, wherein the at least one actuator element comprises a movable body which is coupled to the support element and extends from the frame unit to be actuatable by an external actuator to be moved between a first position in which the screen loading member is in the loaded position and a second position in which the screen loading member is in the screen-receiving position.

9. The frame assembly of claim 8, wherein the at least one actuator element further comprises a biasing element which normally biases the movable body to the first position, with the movable body being moved to the second position against the bias of the biasing element.

10. The frame assembly of claim 8, wherein the first position is an extended position, in which the movable body extends from the frame unit and the second position is a depressed position, in which the movable body is depressed into the frame unit.

11. The frame assembly of claim 1, wherein the frame unit includes a support station adjacent an inner edge thereof onto which a print head can be parked prior to separation of the printing screen from the frame unit to enable removal of the print head and associated print medium from the printing screen prior to separation of the printing screen from the frame unit.

12. A screen printing machine incorporating the frame assembly of claim 1.

13. The screen printing machine of claim 12, wherein the frame unit is provided at least in part by a chassis or supporting frame of the screen printing machine.

14. The screen printing machine of claim 13, wherein the frame unit is provided by a chassis or supporting frame of the screen printing machine.

15. The screen printing machine of claim 13, wherein the frame unit is an integral part of the screen printing machine.

16. A frame assembly for supporting a printing screen, the frame assembly comprising:

a frame unit to which a printing screen is in use supported; and a screen loading mechanism for loading the printing screen into and unloading the printing screen from the frame unit, wherein the screen loading mechanism comprises a screen loading member which receives and supports the printing screen and the screen loading member is movably coupled to the frame unit between a screen-receiving position which is spaced from the frame unit and in which the printing screen can be loaded into or removed from the screen loading member and a loaded position in which the printing screen is moved towards the frame unit and loaded into the frame unit, and at least one actuator element which is coupled to the screen loading member and actuatable to move the screen loading member between the screen-receiving and loaded positions;

wherein the frame unit comprises a plurality of frame members, and the screen loading member comprises a plurality of support elements which are movably coupled to respective ones of the frame members, wherein the screen loading member comprises three support elements which together define a U-shaped profile when viewed from above, with first and second of the support elements being disposed in opposed relation slidingly to receive the printing screen from the one, proximal ends thereof and the other, third support element extending between the other, rear ends thereof.

17. A frame assembly for supporting a printing screen, the frame assembly comprising:

a frame unit to which a printing screen is in use supported, wherein the frame unit includes a support station adjacent an inner edge thereof onto which a print head can be parked prior to separation of the printing screen from the frame unit to enable removal of the print head and associated print medium from the printing screen prior to separation of the printing screen from the frame unit, wherein the support station comprises a platform which extends inwardly from a lower surface of the respective edge of the frame unit to allow for sliding movement of the print head thereonto; and a screen loading mechanism for loading the printing screen into and unloading the printing screen from the frame unit, wherein the screen loading mechanism comprises a screen loading member which receives the printing screen and is movably coupled to the frame unit between a screen-receiving position in which the printing screen can be loaded into or removed from the screen loading member and a loaded position in which the printing screen is loaded into the frame unit, and at least one actuator element which is coupled to the screen loading member and actuatable to move the screen loading member between the screen-receiving and loaded positions.

18. The frame assembly of claim 17, wherein the platform comprises a sheet element.

19. A frame support mechanism for supporting a frame assembly which includes a de-mountable printing screen, the frame support mechanism comprising:

a frame support member to which a frame assembly is in use supported, wherein the frame assembly comprises a frame unit and a screen loading member which is adapted to receive and support the printing screen in a screen-receiving position which is spaced from the frame unit and in which the printing screen can be loaded into or removed from the screen loading member, and the screen loading member is movable between the screen-receiving position and a loaded position which is spaced from the screen-receiving position and in which the printing screen is moved towards the frame unit and loaded in an operative position into the frame unit, and at least one actuator element which is coupled to the screen loading member and actuatable to move the screen loading member between the screen-receiving and loaded positions; and an actuator mechanism which is operable to actuate the at least one actuator element of the frame assembly to move the screen loading member of the frame assembly between the screen-receiving and loaded positions.

* * * * *